United States Patent [19]

Kawamura et al.

[11] Patent Number: 5,033,427

[45] Date of Patent: Jul. 23, 1991

[54] HEAT-INSULATING ENGINE STRUCTURE

[75] Inventors: Hideo Kawamura, Samukawa; Hiroshi Matsuoka, Yamato, all of Japan

[73] Assignee: Isuzu Motors Limited, Tokyo, Japan

[21] Appl. No.: 544,095

[22] Filed: Jun. 26, 1990

Related U.S. Application Data

[63] Continuation of Ser. No. 198,488, May 23, 1988, abandoned.

[30] Foreign Application Priority Data

May 30, 1987 [JP] Japan ..... 62-133301
May 30, 1987 [JP] Japan ..... 62-133302

[51] Int. Cl.[5] ..... F02F 3/00; F02F 1/00

[52] U.S. Cl. ..... 123/193 CH; 123/193 H; 123/193 CP; 123/668

[58] Field of Search ..... 123/193, 657, 668, 669, 123/671

[56] References Cited

U.S. PATENT DOCUMENTS

| | | | |
|---|---|---|---|
| 1,891,326 | 12/1932 | Head | 123/671 |
| 3,882,841 | 5/1975 | Silverstein | 123/193 CP |
| 4,530,341 | 7/1985 | Palm | 123/193 P |
| 4,649,806 | 3/1987 | Hartsock | 123/193 P |
| 4,697,554 | 10/1987 | Bothwell | 123/193 H |
| 4,709,621 | 12/1987 | Matsui et al. | 123/193 P |
| 4,735,128 | 4/1988 | Mahrus et al. | 123/193 P |
| 4,774,926 | 10/1988 | Adams | 123/668 |
| 4,848,291 | 7/1989 | Kawamura et al. | 123/193 P |
| 4,864,987 | 9/1989 | Kawamura | 123/668 |
| 4,909,230 | 3/1990 | Kawamura | 123/193 CH |

FOREIGN PATENT DOCUMENTS

| | | | |
|---|---|---|---|
| 0163241 | 5/1985 | European Pat. Off. . | |
| 3126028 | 1/1984 | Fed. Rep. of Germany . | |
| 43152 | 3/1985 | Japan | 123/193 CH |
| 66848 | 4/1986 | Japan | 123/193 P |
| 30756 | 9/1908 | Sweden | 123/671 |
| 2075147 | 11/1981 | United Kingdom | 123/193 P |

*Primary Examiner*—Andrew M. Dolinar
*Assistant Examiner*—M. Macy
*Attorney, Agent, or Firm*—Browdy and Neimark

[57] ABSTRACT

In order to improve the suction efficiency and the cycle efficiency, a heat-insulating engine structure of the invention has a planar and thin-walled piston head surface portion of a ceramics material to be exposed to combustion gases. A combustion chamber is formed not on the side of the piston head but on the side of a cylinder head. Namely, the piston head is defined by the cooperation of a cylinder head bottom wall portion having a lowered central portion and a raised outer peripheral portion and a cylinder liner upper portion including an upper tubular part of a substantially square cross-section and a lower cylindrical part. The cylinder head bottom wall portion has an inclined surface radially upwardly extending from the central portion to the outer peripheral portion. Intake and exhaust valves are associated with valve seats formed in the inclined surface. A fuel injection nozzle is disposed substantially centrally of the cylinder head bottom wall portion. The sides of the square tubular part are operative to agitate a swirl to facilitate uniform mixture of fuel and air thereby assuring that the fuel and air are mixed instantaneously in a zone adjacent to the top dead center of the piston.

22 Claims, 4 Drawing Sheets

HEAT-INSULATING ENGINE STRUCTURE

This application is a continuation of application Ser. No. 07/198,488 filed May 23, 1988, now abandoned.

BACKGROUND OF THE INVENTION

1. Field of the Invention

The present invention relates to a heat-insulating engine structure.

2. Description of the Prior Art

A heat-insulating engine which makes use of heat-insulating members and heat-resistant members both made of a ceramics material has heretofore been known and is disclosed, for example, in Japanese Un-Examined Patent Publication No. 59-122, 765. This heat-insulating engine will be described with reference to FIG. 5 of the accompanying drawings. This heat-insulating engine 50 includes a cylinder head 53 of a cast metal and a liner head 51 of a ceramics material fitted into the cylinder head with positioning rings 66 and 67 interposed therebetween. The liner head 51 constitutes a cylinder head bottom wall portion 63 and an integral cylinder liner upper portion 64 both of which are exposed to combustion gases at the highest temperature and pressure levels during each cycle of engine operation and from which heat is removed most during the engine operation. A cylinder block 69 is disposed under the bottom end of the liner head 51 with a gasket 65 interposed therebetween. The cylinder block 69 is fitted with a cylinder liner 52 which accommodates a reciprocating piston having a piston head 54 of silicon nitride. The piston head is recessed in its central area, as shown at numeral 55, to provide a combustion chamber 62 and has an inwardly stepped bottom end 56 which serves as means for positioning and preventing the piston head 54 from being moved relative to a piston body 57 when the piston head is assembled with the piston body. A bolt hole 68 is formed in and extends through the bottom wall of the recess 55. The outer periophery of the top of the piston body 57 is shaped to provide an annular projection 58 which is snugly engaged with the inwardly stepped bottom end of the piston head 54. The upper face of the piston body has an upwardly projecting central portion 59 having a top face engaged with the bottom face of the piston head 54. The piston head and body 54 and 57 are secured together by a bolt 60 extending through the bolt hole 68 in the piston head and through a similar bolt hole in the piston head 57. Intake and exhaust valves 61, only one of which is shown, are disposed adjacent to the cylinder head bottom wall portion and axially of the cylinder liner 52.

The heat-insulating engine 50 is not of a structure which is suited to reduce the thermal capacity as much as possible, because the ceramics piston head 54 is formed therein with the recess 55 and, therefore, is required to have a substantial thickness so as to assure a sufficient mechanical strength. The intake and exhaust valves 61 are disposed axially of the cylinder liner 52 in compliance with the structure of the piston head 54. The cylinder head bottom wall portion 63 is of a flat design, with the result that air sucked into the engine cylinder flows radially outwardly of the intake valve and, accordingly, is apt to receive heat from the upper part of the cylinder liner 64 as well as from the cylinder head bottom wall portion 63. Thus, the cylinder head bottom wall portion is not so structured as to swirl the air for the purpose of agitating the air.

It is very difficult to fully obtain the heat-insulating characteristics of a heat-insulating engine which makes use of ceramics material as heat-insulating or heat-resistant material. The engine is of the structure which exposes the ceramics members to combustion gases at a high temperature, so that the ceramics members are subjected to thermal shocks, which raises a problem in terms of mechanical strength. In the case where the thickness of a ceramics member is increased for the purpose of heat-insulation, the thermal capacity of the member if increased, with a disadvantageous result that air sucked into an engine cylinder during an intake stroke of the cylinder receives heat much from the ceramics member and is heated and expanded to greatly decrease the suction efficiency.

Accordingly, it has been desired to improve the suction efficiency and the cycle efficiency of heat-insulating engines. In addition, it has also been demanded in Diesel engines to assure that a fuel injected from a fuel injection nozzle is quickly and uniformly mixed with air by virtue of swirl formed in a combustion chamber.

SUMMARY OF THE INVENTION

It is a principal object of the present invention to provide a heat-insulating engine which is structured to improve the suction efficiency and the cycle efficiency of the heat-insulating engine as well as to assure that fuel injected from a fuel injection nozzle is immediately and uniformly mixed with intake air, thereby to solve the problems pointed out above. More specifically, in order to improve the suction efficiency and the cycle efficiency, the top face portion of a piston head of the engine which is exposed to combustion gases is formed of a wall of a ceramics material having as small a thickness as possible to minimize the thermal capacity of the piston top face portion. Reduction in the thicknesses of the ceramics wall portions exposed to combustion gases and the resultant decrease in the thermal capacities thereof assure that walls defining a combustion chamber can better follow variation in combustion gas temperature. As compared with the case in which the combustion chamber walls have greater thicknesses, the amplitude of the temperature variation in the combustion chamber walls having smaller thicknesses is increased to advantageously decrease the difference in temperature between the combustion gases and the ceramics material of the combustion chamber walls with a resultant decrease in the heat transfer to thereby reduce the heat transferred from the combustion chamber walls to the air introduced into the combustion chamber. The reduction in the heat transfer to the intake air is effective to prevent undue expansion of the intake air and, thus, assure a smooth flow of air into the combustion chamber, whereby the suction efficiency and the cycle efficiency are greatly improved.

It is another object of the present invention to provide a heat-insulating engine structure in which the top wall portion of a piston, which is exposed to combustion gases, is of a planar design that does not define any combustion chamber and, instead, a combustion chamber is defined in the bottom wall portion of a cylinder head. This is because, in order to reduce the thickness of the top wall portion of the piston, it is most preferred for the top wall portion of the piston to have such a planar configuration.

It is a further object of the present invention to provide a heat-insulating engine structure in which, in order that a combustion chamber may be formed on the side of the cylinder head, rather than on the side of the piston, the bottom wall portion of the ceramics cylinder head is shaped to have a lowered central portion and a raised outer peripheral portion and cooperates with an integral ceramics cylinder liner upper portion to define the combustion chamber. In addition, the cylinder head bottom wall portion has inclined surfaces extending radially upwardly from the central portion to the outer peripheral portion and is provided with intake and exhaust valve seats formed in the inclined surfaces. A fuel injection nozzle is disposed substantially centrally of the cylinder head bottom wall portion, so that the above-mentioned combustion chamber is shaped to accommodate the pattern of jets of fuel injected by the fuel injection nozzle. Thus, the injected fuel can be immediately agitated with intake air and thus uniformly mixed therewith due to an agitating flow produced in the combustion chamber.

It is a still further object of the present invention to provide a heat-insulating engine structure in which a cylinder head bottom wall section and a cylinder liner upper portion which cooperates therewith to define a combustion chamber are thermally insulated from the cylinder head by an heat insulating layer, the surface of a piston which is exposed to combustion gases, i.e., a thin-walled piston top wall portion, is thermally insulated from a piston head by a heat insulating layer, and the cylinder liner upper portion, the cylinder head bottom wall portion and the piston top surface portion are designed to have as small thicknesses as possible to minimize their heat capacities as well as to provide the engine with highly improved heat-resisting characteristic, heat-insulating characteristic, anti-deformation characteristic and anti-corrosion characteristic.

It is a still further object of the present invention to provide a heat-insulating engine in which intake and exhaust valve seats are formed in radially upwardly inclined surfaces of cylinder heat bottom wall section such that intake and exhaust valves are disposed in an inverted-V arrangement and, more particularly, the primary flow of air introduced into the combustion chamber when the intake valve is opened is disposed substantially centrally of the combustion chamber and, thus, of a cylinder bore to reduce the possibility that the air flowing into the combustion chamber is brought into contact with the inner surface of a heated upper portion of a cylinder liner whereby the transfer of heat from the cylinder liner upper portion to the air is decreased to minimize the expansion of the air to thereby improve the suction efficiency of the engine.

It is a still further object of the present invention to provide a heat-insulating engine in which a cylinder liner which defines a combustion chamber therein has a lower cylindrical portion and an upper tubular portion of a substantially square cross-section having a non-circular inner peripheral configuration which is effective to destroy the swirl formed in the combustion chamber to cause an agitation which is effective to assure that the fuel injected by a fuel injection nozzle is immediately and uniformly mixed with intake air in a zone adjacent to the piston top dead center.

It is a still further object of the present invention to provide a heat-insulating engine structure in which the primary flow of intake air is disposed centrally of a combustion chamber and, thus, of a cylinder with a resultant increase in the quantity of intake air that is brought into contact with a thin-walled portion disposed on a piston head through the intermediary of a heat insulating material and exposed to combustion gases, and in which the thin-walled portion is structured to have a very small thermal capacity so as to eliminate decrease in the suction efficiency whereby the suction efficiency and the cycle efficiency of the engine are improved.

It is a still further object of the present invention to provide a heat-insulating engine in which a fuel injection nozzle is disposed substantially centrally of a cylinder head bottom wall portion and a combustion chamber is shaped to accommodate the loci or pattern of jets of fuel injected from a fuel injection nozzle to reduce the transfer of heat to the injected fuel and the intake air in the combustion chamber so that expansion of the air can be suppressed and the injected fuel can be well mixed with the air to ensure a good combustion.

It is a still further object of the present invention to provide a heat-insulating engine in which a piston has a piston head portion of cermet and a thin-walled portion of a ceramics material having a coefficient of thermal expansion substantially equal to that of cermet to provide a reliable connection between the two portions, in which the piston head portion of cermet is highly rigid and hardly deformed even by a high level of pressure to assure a stable connection between the piston head portion and the piston thin-walled portion, to establish a reliable gas-seal at the boundary therebetween and to avoid any strength problem which would otherwise be adversely affected by thermal shock, in which the heat-resisting characteristic, anti-deformation characteristic and anti-corrosion characteristic and so forth of the piston are improved, and in which the pressure exerted to the thin-walled portion of the piston in each combustion stroke can be borne through a heat-insulating material by the piston head portion.

It is a still further object of the present invention to provide a heat-insulating engine in which a heat-insulating material interposed between a thin-walled portion of a piston and a piston head portion is made of potassium titanate whisker, zirconia fiber or of a mixture of these materials and glass fiber to provide a highly efficient heat-insulator against the heat produced in an associated combustion chamber to eliminate leakage of thermal energy from the combustion chamber through the piston whereby the thermal energy is trapped inside the combustion chamber to assure that the thermal energy can be collected by means of an energy-collector disposed at a downstream point of the flow of engine exhaust gases.

The above and other objects, features and advantages of the invention will become more apparent from the following description with reference to the accompanying drawings.

DESCRIPTION OF THE PREFERRED EMBODIMENTS

Figure 1:
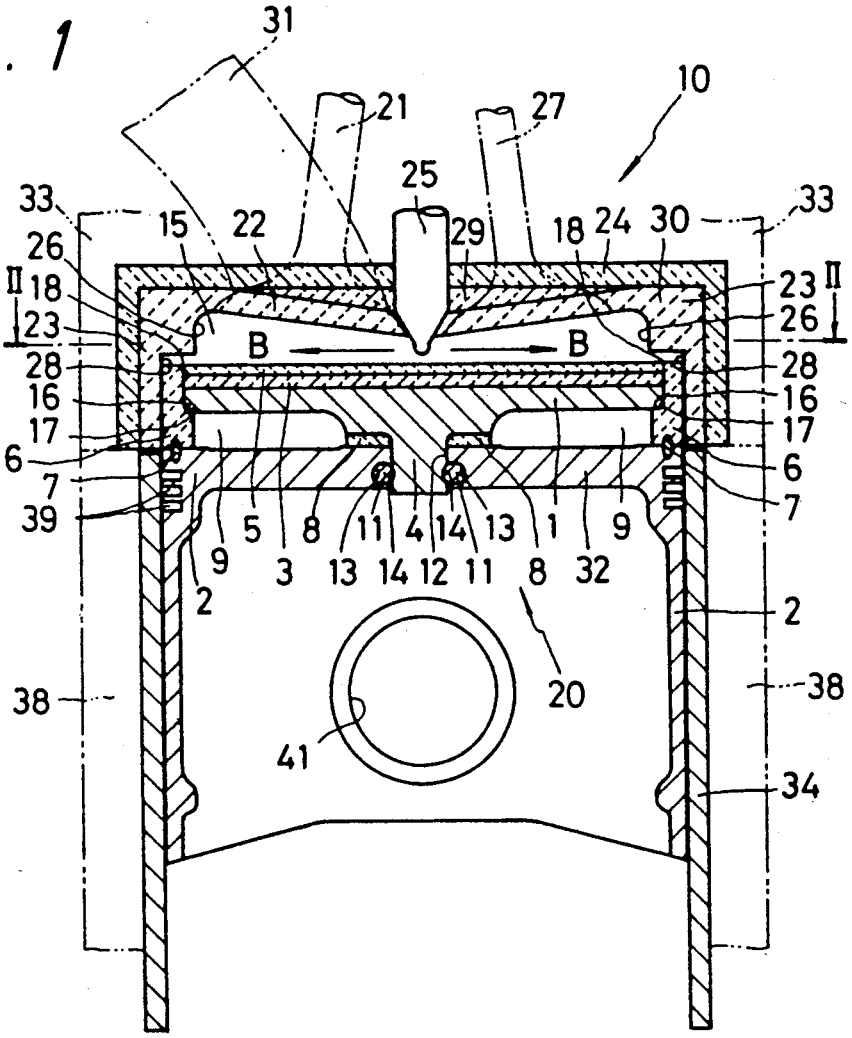
FIG. 1 is an axial sectional view of an embodiment of a heat-insulating engine according to the present invention.

Referring first to FIG. 1 showing the structure of a heat-insulating engine embodying the present invention, the engine 50 is generally designated by reference numeral 10 and constituted mainly by a piston 20 which reciprocates within a cylinder liner 34 fitted into a cylinder block 38 and formed by a piston head portion 1 and a piston skirt portion 2 of a metal, a liner head 30 fitted in a metallic cylinder head 33 with a heat-insulating layer interposed therebetween and made of a ceramics material such as a silicon nitride or a silicon carbide, a fuel injection nozzle 25 disposed centrally of the liner head 30, and an intake valve 21 and an exhaust valve 27 both disposed adjacent to the undersurface of the liner head 30. A flat or planar and thin-walled portion 5 of a ceramics material is mounted, via a heat-insulating material 3, on the side of the piston head portion 1 which is adjacent to a combustion chamber to be described. The thin-walled portion 5 is shaped to provide a planar surface which is to be exposed to combustion gases. To accord with this planar surface of the thin-walled portion 5, the liner head 30 is shaped to define a combustion chamber 15 having a lowered part and a raised part which are disposed adjacent to the central and outer peripheral zones of the cylinder and thus will be termed "lowered central part" and "outer peripheral part", respectively. The liner head 30 is constituted by a cylinder liner upper portion 23 disposed above the cylinder liner 34 and a cylinder head bottom wall portion 22 integral with the cylinder liner upper portion 23. The cylinder head bottom wall portion 22 is shaped to have a raised outer peripheral part and a lowered central part to provide an inclined surface extending radially upwardly from the lowered central part to the raised outer peripheral part. The heat-insulating engine 10 equipped with the liner head 30 of the described structure is of the structure which is suited to insulate heat particularly during a heat-producing period when a combustion is most active. The combustion chamber 15, which is defined by the cooperation of the liner head 30 and the thin-walled element 5 of the piston head portion 1, both having the structures described above, is most suited to a heat-insulating engine and presents a configuration or profile resembling the shape of a shallow dish providing a radially outwardly increasing volume. The piston is provided with piston rings 39 received in piston ring grooves and has a pin hole 41 for a piston pin.

Figure 2:
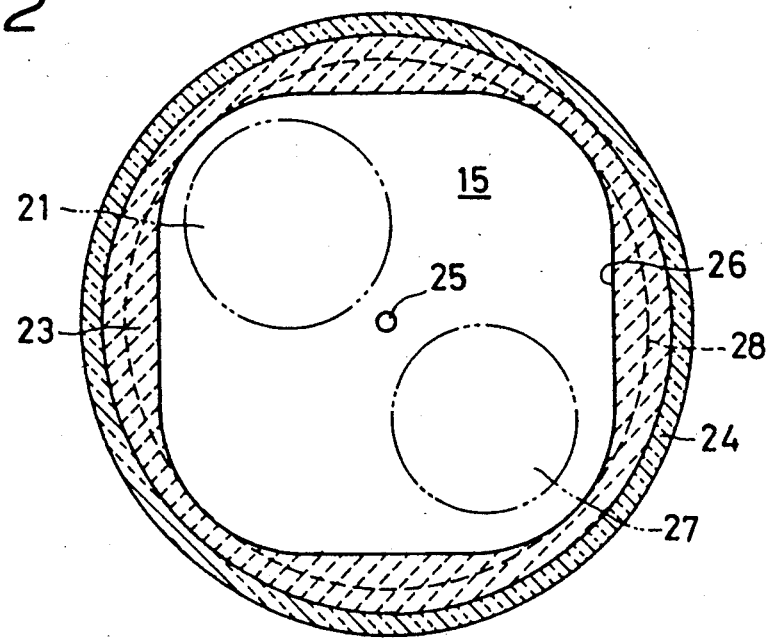
FIG. 2 is a cross-sectional view of the engine taken along line II—II in FIG. 1.

FIG. 2 is a cross-sectional view taken along line II—II in FIG. 1. The cylinder liner upper portion 23, which cooperates with the piston to define the combustion chamber 15, has an upper tubular part 26 of a generally square cross-section and a lower cylindrical part 28 of a circular cross-section. The square tubular part 26 is smaller in diameter than the cylindrical part 28. The square tubular part 26 has corners each of which, from the view point of the flow of the fluid, is preferably rounded with a radius of curvature equal to about from ½ to ⅓ the radius of the cylindrical part. This design is effective to assure that the four sides of the square cross-section of the square tubular part 26 are operative to destroy a swirl produced within the combustion chamber 15, or in other words, to break the swirl to establish an agitation by which injected fuel and intake air are very quickly and uniformy mixed in a zone adjacent to the top dead center of the piston to thereby facilitate a good combustion. The outer surfaces of the liner head 30 are thermally insulated by a heat-insulating gasket 29 of potassium titanate and by a heat-insulating layer 24. Thus, the liner head 30 itself can be designed to have a reduced wall thickness and, thus, a small thermal capacity. As will be clearly seen in FIG. 2, moreover, the intake valve 21 and the exhaust valve 27 are so disposed as to cooperate with intake and exhaust valve seats formed in the inclined surface of the cylinder head bottom wall portion 22 which surface extends between the central and outer peripheral portions thereof. More specifically, the cylinder head bottom wall portion 22 has its major part extending radially outwardly and upwardly to provide the above-mentioned inclined surface, as shown in FIG. 1, so that the intake and exhaust valves 21 and 27 associated with the intake and exhaust valve seats formed in the inclined surface are disposed in an inverted V-shape arrangement (but the valves may alteratively be disposed in parallel with the cylinder axis.).

Figure 4:
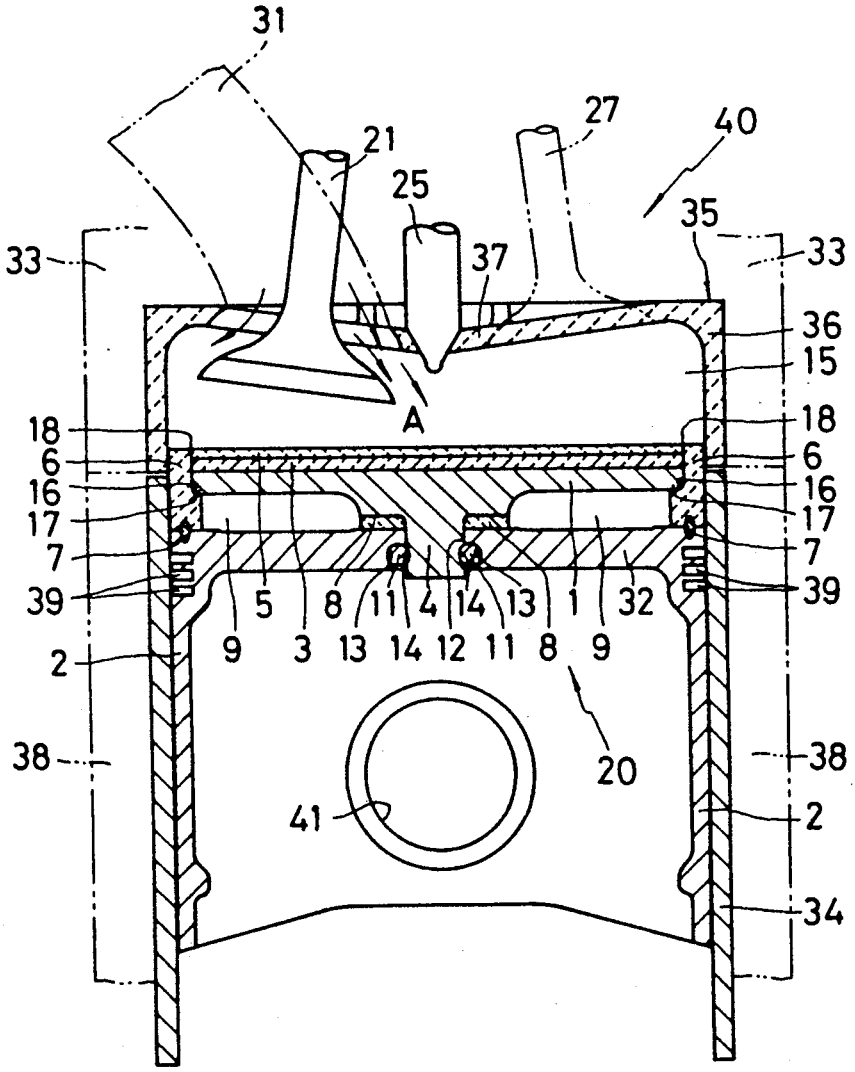
FIG. 4 is similar to FIG. 3 but illustrates a flow of air in a combustion chamber.
Figure 5:
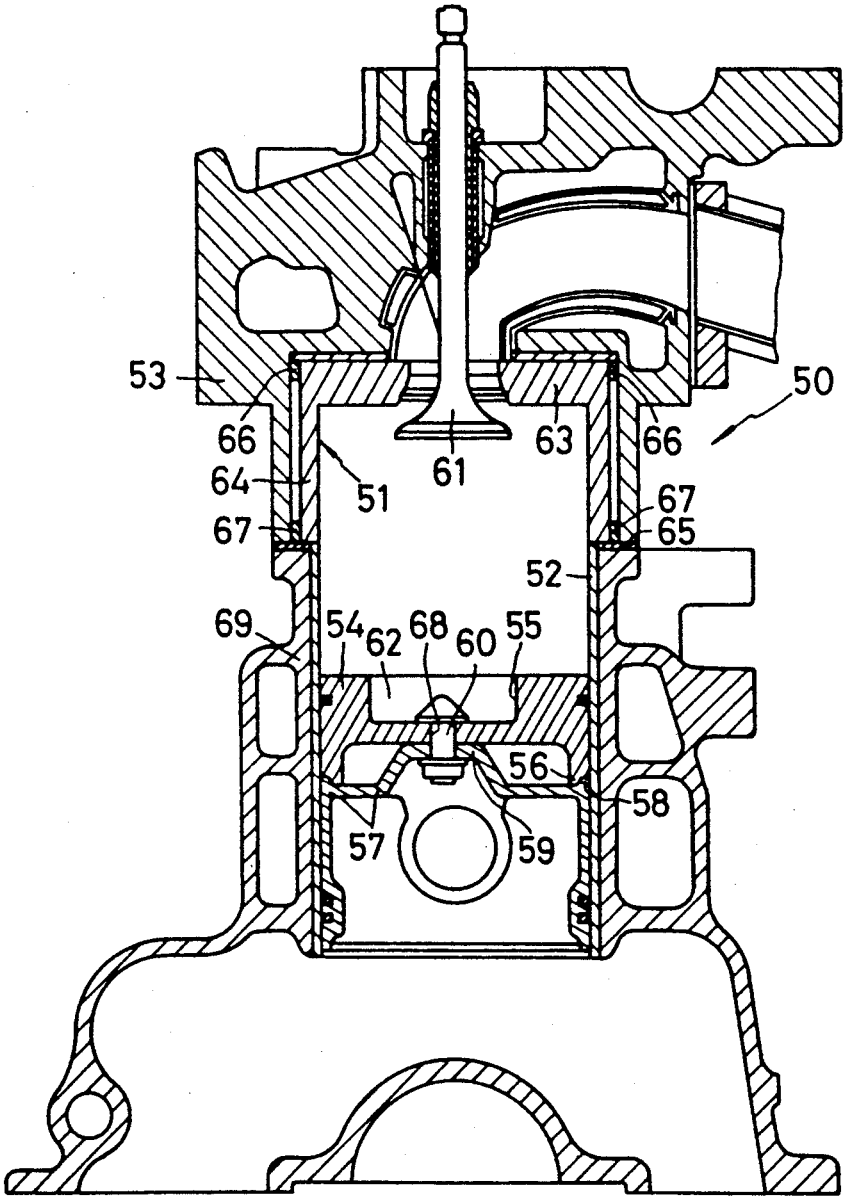
FIG. 5 (Prior art)
FIG. 5 is an axial sectional view of the prior art heat-insulating engine discussed hereinabove.

Due to this inclined arrangement of the intake valve 21 and due to the shape of an intake port 31 extending radially inwardly and obliquely from outside the combustion chamber 15 to the cylinder head bottom wall portion 22, the intake air sucked into the combustion chamber has its primary flow directed substantially vertically of the engine towards the center of the combustion chamber (refer to the air flow shown by arrows A in FIG. 4 and described later). Accordingly, the intake air is hardly brought into contact with the inner surface of the liner head 30 which is at a high temperature during each intake stroke of the engine, with a result that the heat transfer from the liner head to the intake air is advantageously reduced to minimize the thermal expansion of the air and, thus, to eliminate reduction in the suction efficiency which would otherwise be caused. In this case, the amount of intake air would be increased which is brought into contact with the thin-walled portion 5 of the piston head 1, i.e., the top face of the piston. Such increase, however, will not give rise to decrease in the suction efficiency because the thin-walled portion 5 of the piston 20 is structured to have a very small thermal capacity. On the other hand, because the intake valve 21 and the exhaust valves 27 are disposed in the combustion chamber 15, these valves do not interfere with the piston 20 even if the valves were accidentally opened when the piston 20 is in its top dead center, thereby to assure a reliable and safe engine operation. In addition, the fuel injection nozzle 25 has its injection orifices directed radially outwardly. Thus, the jets of fuel injected through the injection orifices are directed in parallel with and radially outwardly of the thin-walled portion 5 of the piston head 1. It will therefore be appreciated that the combustion chamber 15, which is partly defined by the liner head 30, is shaped to accommodate the loci of the jets of fuel injected by the fuel injection nozzle 25 (see the pattern of the jets of fuel shown by arrows B in FIG. 1).

Then, the piston 20 will be described. This piston 20 is constituted mainly by a piston skirt 32 having an upper end wall 32, the above-mentioned piston head portion 1 which has a mounting hub 4 by which the piston head portion is mounted on the skirt upper end wall 32, a ring 6 of a ceramics material secured to the upper face of the skirt 2 in pressure-contact therewith, the above-mentioned thin-walled portion 5 of a ceramics material having an outer periphery bonded to the ring 6 and providing a surface to be exposed to combustion gases, and a layer of a heat-insulating material 3 interposed between the piston head portion 1 and the thin-walled portion 5. The piston head portion 1 has the mounting hub 4 in its center and is made of a material, such as, for example, cermet or a metal, which has a thermal expansion coefficient substantially equal to that of a ceramics material, a high strength and a relatively high Young's modulus. The piston head 1 itself is not formed therein with any combustion chamber and is planar or flat in its side adjacent to the combustion chamber 15. The upper end wall 2 of the piston skirt 2 is formed therein with a central mounting hole 12 for receiving the mounting hub 4 of the piston head portion 1. The piston head mounting hub 4 is fitted into the mounting hole 12 in the piston skirt upper end wall 32 with a metallic ring 11 press-fitted into and interconnecting an annular groove 14 in the outer peripheral surface of the mounting hub 4 and an annular groove 13 in the inner peripheral surface of the mounting hole 12 so that the piston head portion 1 is secured to the piston skirt 2. A shock absorbing member 8 formed of a heat-insulating material is interposed and pressed between the piston head portion 1 around the mounting hub 4 and the piston skirt 2 around the central mounting hole 12 and acts also as a heat-insulator. A heat-insulating air chamber 9 is defined by the cooperation of the undersurface of the piston head portion 1, the upper surface of the piston skirt 2 and the inner peripheral surface of the ring 6. It is to be understood that the thin-walled portion 5 of the piston 20 is so disposed on the piston head portion 1 as to face the combustion chamber 15, i.e., exposed to combustion gases, with the heat insulating material 3 interposed between the thin-walled portion 5 and the piston head portion 1. The thin-walled portion 5 is made of a ceramics material such as silicon nitride or silicon carbide and has a thickness of about 1 mm or less.

The outer periphery of the thin-walled portion 5 is bonded to the ring 6 which is made of a similar material. The bonding between the thin-walled portion 5 and the ring 6 is achieved by, for example, a chemical vapor deposition of a ceramics material at a junction 18 therebetween. The inner peripheral surface of the ring 6 is formed thereon with an annular shoulder or step 16. The piston head 1 has an outer periphery 17 which is fitted into the ring 6 and disposed in engagement with the annular step 16. The upper surface of the piston head portion 1, the undersurface of the thin-walled portion 5 and a part of the inner peripheral surface of the ring cooperate together to define a space which is filled with the heat-insulating material 3. This heat-insulating material 3 is made from potassium titanate whisker, zirconia fiber or the like and acts not only as a heat-insulating layer but also as a structural member which bears the pressure exerted to the thin-walled portion 5 and produced when a combustion takes place in the combustion chamber 15.

Because the piston head 1 is urged against and connected to the piston skirt 2, the outer periphery 17 of the piston head portion 1 is urged against the annular step 16 on the ring 6 which in turn is urged against the outer periphery of the upper surface of the piston skirt 2. The junction between the ring 6 and the piston skirt 2 is sealed by a gasket formed by a carbon seal 7 interposed therebetween. An axial sealing force is exerted to and acts on the carbon seal 7 because the piston head portion 1 is urged against and secured to the piston skirt 2. It is a requirement for the structure of the piston 20 that the heat-insulating material 3 uniformly receives a compression force produced by a combustion. So as to comply with this requirement, the surface of the piston head 1 adjacent to the combustion chamber and the thin-walled ceramics portion 5 are designed to be planar.

Figure 3:
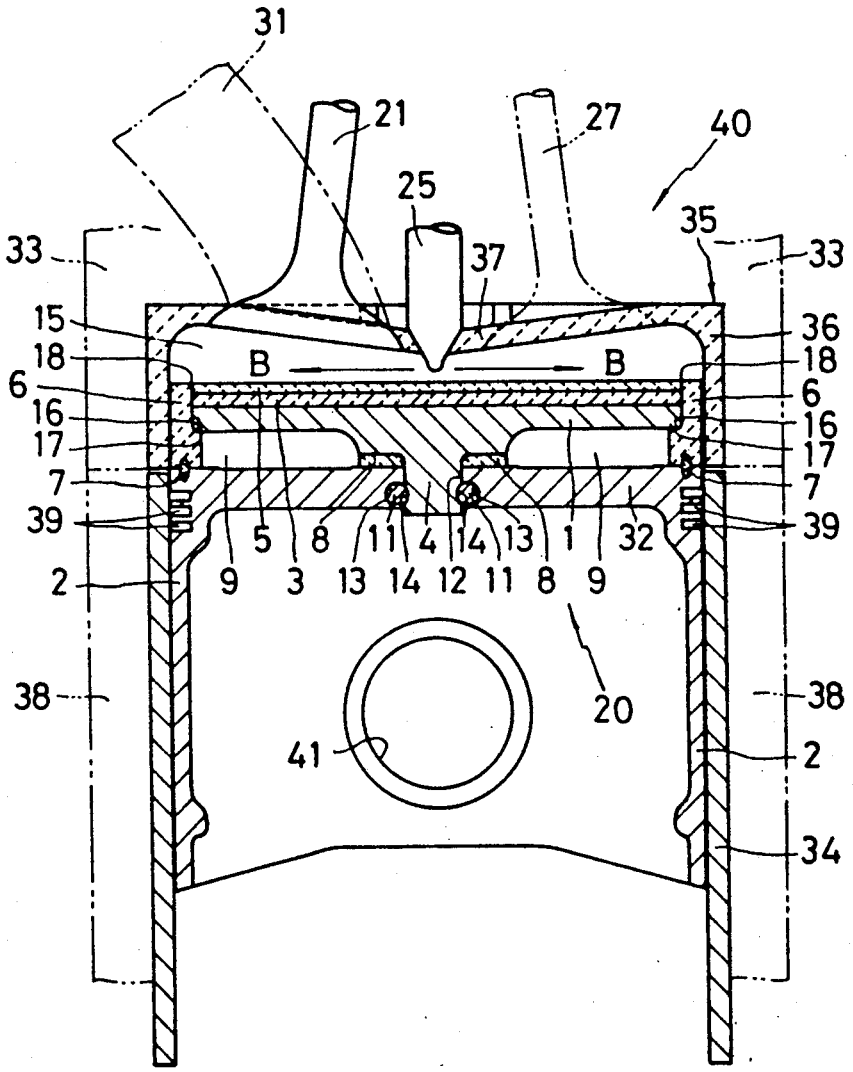
FIG. 3 is an axial sectional view of another embodiment of the heat-insulating engine according to the present invention.

Another or second embodiment of the heat-insulating engine according to the present invention will be described with reference to FIGS. 3 and 4. The heat-insulating engine of the second embodiment is distinguished from the heat-insulating engine of the embodiment described with reference to FIG. 1 only in the shape of the liner head constituted by the cylinder head bottom wall portion and the cylinder liner upper portion. The portions of the second embodiment which are the same as those of the first embodiment are designated by the same reference numerals and thus are not described hereinunder for the purpose of simplification of the description. The heat-insulating engine of the second embodiment is generally designated by reference numeral 40 and has a liner head 35 which constitutes a cylinder head bottom wall portion 37 and an integral cylindrical liner upper portion 36. The cylinder head bottom wall portion 37 of the heat-insulating engine 40 is shaped to provide a raised outer peripheral portion and a lower central portion as in the cylinder head bottom wall portion 22 of the heat-insulating engine 10 of the first embodiment. Thus, the cylinder head bottom wall portion 37 provides an inclined surface extending radially outwardly and upwardly from the central portion to the outer peripheral portion. Accordingly, the combustion chamber 15 which is defined by the cooperation of the cylinder head bottom wall portion of the described shape and the flat thin-walled portion 5 of the piston head 1 is most suited for a heat-insulating engine and resembles the shape of a shallow dish providing a radially outwardly increasing volume. With respect to the intake valve 21, the fuel injection nozzle 25 and the piston 20, the engine 40 of the second embodiment is entirely the same as the engine 10 of the first embodiment. The flow of air introduced in each intake stroke of the heat-insulating engine 40 is shown by arrows A in FIG. 4. The flow of intake air into the combustion chamber 15 and the directions of the jets of fuel injected from a fuel injection nozzle 25 into the combustion chamber are also entirely the same as those in the first embodiment.

What is claimed is:

1. A heat-insulating engine structure comprising:

a piston reciprocatingly movable in a cylinder liner said piston having a piston skirt portion, a piston head portion fixed to said piston skirt portion, a heat insulating material provided on the upper surface of said piston head portion, and a surface portion provided on the upper surface of said heat insulation material and exposed to combustion gases; said surface portion consisting of a wholly flat, thin ceramic plate portion;

a cylinder head bottom wall portion which is made of a ceramics material is, integral with said cylinder liner upper portion, and extends upwardly from its center to periphery so as to have a raised outer peripheral portion all over the circumference of said portion and a lowered central portion; a cylinder head including a tubular section accommodating said integral cylinder liner upper portion and said cylinder head bottom wall portion;

said cylinder head bottom wall portion and said cylinder liner upper portion cooperating to define a combustion chamber;

a fuel injection nozzle disposed substantially centrally of said cylinder head bottom wall portion and having radially outwardly directed injection orifices;

intake and exhaust valve seats formed in an inclined surface of said cylinder head bottom wall portion, said inclined surface extending radially upwardly from said central portion of said cylinder head bottom wall portion to said outer peripheral portion thereof; and intake and exhaust valves associated with said intake and exhaust valve seats, respectively.

2. A heat-insulating engine structure comprising:

a piston reciprocatingly movable in a cylinder liner and having a thin-walled portion whose surface is planar and exposed to combustion gases:

a cylinder liner upper portion of ceramics material disposed above said cylinder liner;

a cylinder head bottom wall portion which is made of a ceramics material is, integral with said cylinder liner upper portion, and extends upwardly from its center to periphery so as to have a raised outer peripheral portion all over the circumference of said portion and a lowered central portion; a cylinder head including a tubular section accommodating said integral cylinder liner upper portion and said cylinder head bottom wall portion;

said cylinder liner upper portion has a tubular upper part of substantially square cross-section and a substantially cylindrical lower part, said cylinder head bottom wall portion and said cylinder liner upper portion cooperating to define a combustion chamber; said combustion chamber including a substantially square portion defined by said tubular upper part of said cylinder liner upper portion;

a fuel injection nozzle disposed substantially centrally of said cylinder head bottom wall portion and having radially outwardly directed injection orifices;

intake and exhaust valve seats formed in an inclined surface of said cylinder head bottom wall portion, said inclined surface extending radially upwardly from said central portion of said cylinder head bottom wall portion to said outer peripheral portion thereof; and intake and exhaust valves associated with said intake and exhaust valve seats, respectively.

3. A heat-insulating engine structure according to claim 2, wherein said tubular upper part of substantially square cross-section is smaller than the inner diameter of said cylindrical lower part.

4. A heat-insulating engine structure according to claim 2, wherein said tubular upper part has rounded corners.

5. A heat-insulating engine structure according to claim 1, wherein said fuel injection nozzle injects a fuel radially outwardly through said injection orifices into said combustion chamber.

6. A heat-insulating engine structure according to claim 1, wherein said cylinder head bottom wall portion and said cylinder liner upper portion are of an integral thin-walled structure of a ceramics material.

7. A heat-insulating engine structure according to claim 1, wherein said cylinder head bottom wall portion and said cylinder liner upper portion are of an integral structure of silicon nitride.

8. A heat-insulating engine structure according to claim 1, wherein said cylinder head bottom wall portion and said cylinder liner upper portion are of an integral structure of silicon carbide.

9. A heat-insulating engine structure according to claim 1, wherein a heat-insulating layer is disposed between said cylinder head bottom wall portion and said cylinder and between an outer peripheral surface of said cylinder liner upper portion and an inner peripheral surface of said cylinder head.

10. A heat-insulating engine structure according to claim 8, wherein said heat-insulating layer includes a heat-insulating material made of potassium titanate and the like.

11. A heat-insulating engine structure according to claim 1, wherein said intake and exhaust valves are disposed in a generally inverted V arrangement.

12. A heat-insulating engine structure according to claim 10, wherein said cylinder head is formed therein with an intake port extending obliquely and radially inwardly to said intake valve seat.

13. A heat-insulating engine structure according to claim 11, wherein intake air introduced through said intake port into said combustion chamber in each suction stroke of the engine includes a primary flow disposed substantially vertically centrally of said combustion chamber.

14. A heat-insulating engine structure according to claim 13, wherein sprays of fuel injected into said combustion chamber and intake air form a swirl and wherein said tubular upper part of substantially square cross-section has sides operative to agitate said swirl whereby the fuel and the air are immediately and uniformly mixed.

15. A heat-insulating engine structure according to claim 1, wherein said piston includes a piston skirt having an upper end wall, a piston head portion having a mounting portion by which said piston head portion is mounted on said upper end wall, a ring of a ceramics material urged against and secured to an upper surface of said piston skirt, a thin-walled portion constituting said planar surface and having an outer periphery bonded to said ring, said piston head portion having an undersurface cooperating with an undersurface of said thin-walled portion and with a part of an inner peripheral surface of said ring to define a space, and a heat-insulating material disposed in and filling up said space.

16. A heat-insulating engine structure according to claim 14, wherein said thin-walled portion constitutes said planar surface to be exposed to combustion gases and is made of a ceramics material having as thin a wall thickness as possible.

17. A heat-insulating engine structure according to claim 15, wherein the outer periphery of said thin-walled portion is bonded to an upper part of said ring by a chemical vapor deposition of a ceramics material.

18. A heat-insulating engine structure according to 15, wherein said piston head has a planar upper surface.

19. A heat-insulating engine structure according to claim 15, wherein said heat-insulating material acts as a structural member which bears a pressure acting on said thin-walled portion.

20. A heat-insulating engine structure according to claim 15, wherein said thin-walled portion and said ring are made of silicon nitride.

21. A heat-insulating engine structure according to claim 15, wherein said thin-walled portion and said ring are made of silicon carbide.

22. A heat-insulating engine structure comprising:

a piston reciprocatingly movable in a cylinder liner, said piston having a piston skirt portion, a piston head portion fixed to said piston skirt portion, a heat insulating material provided on the upper surface of said piston head portion, and a surface portion provided on the upper surface of said heat insulating material and adapted to be exposed to combustion gases, said surface portion consisting of an entirely flat and thin ceramic plate portion;

a cylinder head bottom wall portion of ceramic material, integral with said cylinder linear upper portion, and extending upwardly from a central part to a periphery thereof so as to have a raised outer peripheral part all over the circumference of said portion and a lowered central part, said cylinder head bottom wall portion and said flat thin ceramic plate portion of said piston defining therebetween a combustion cavity having a cross-sectional height which varies from a minimum adjacent the central part of said cylinder head bottom wall portion to a maximum adjacent the peripheral part of said cylinder head bottom wall portion;

a cylinder head including a tubular section accommodating said integral cylinder liner upper portion and said cylinder head bottom wall portion;

a fuel injection nozzle disposed substantially centrally of said cylinder head bottom wall portion and having radially outwardly directed injection orifices;

intake and exhaust valve seats formed in an inclined surface of said cylinder head bottom wall portion, said inclined surface extending radially upwardly from said central portion of said cylinder head bottom wall portion to said outer peripheral portion thereof; and intake and exhaust valves associated with said intake and exhaust valve seats, respectively.

* * * * *